US008356883B2

(12) United States Patent
Billow et al.

(10) Patent No.: US 8,356,883 B2
(45) Date of Patent: Jan. 22, 2013

(54) INKJET PRINTING METHOD FOR COLORLESS INK USING COLORLESS INK PRINTHEAD MASKS DEPENDENT ON COLORED INK PRINTING

(75) Inventors: Steven A. Billow, Victor, NY (US); Douglas W. Couwenhoven, Fairport, NY (US); James A. Mott, San Diego, CA (US); Yang Shi, San Diego, CA (US); Richard C. Reem, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 1036 days.

(21) Appl. No.: 12/026,953

(22) Filed: Feb. 6, 2008

(65) Prior Publication Data

US 2009/0195601 A1 Aug. 6, 2009

(51) Int. Cl.
*B41J 2/21* (2006.01)

(52) U.S. Cl. ..... 347/43; 347/49; 347/98

(58) Field of Classification Search ..... 347/100, 347/98, 96, 49, 43, 40
See application file for complete search history.

(56) References Cited

U.S. PATENT DOCUMENTS

| | | | | |
|---|---|---|---|---|
| 6,102,537 | A * | 8/2000 | Kato et al. | 347/101 |
| 6,464,330 | B1 * | 10/2002 | Miller et al. | 347/40 |
| 2003/0189626 | A1 * | 10/2003 | Kataoka et al. | 347/98 |
| 2003/0193553 | A1 * | 10/2003 | Issler | 347/100 |
| 2006/0103691 | A1 | 5/2006 | Dietl et al. | |
| 2006/0146090 | A1 * | 7/2006 | Fellingham et al. | 347/41 |
| 2007/0201054 | A1 | 8/2007 | Billow et al. | |

* cited by examiner

*Primary Examiner* — Mark Robinson
*Assistant Examiner* — Andrew Jordan
(74) *Attorney, Agent, or Firm* — Kevin E. Spaulding

(57) ABSTRACT

A printing method includes applying at least one of a plurality of pigmented colored inks to a receiving surface. A colorless ink is applied to the receiving surface. A majority of the colorless ink is ejected from of first nozzles on a printhead used for ejecting the colorless ink. At least 30% of an area on the receiving surface, which is passed over by the first nozzles, is covered with the colorless ink during a single pass of the printhead over the area.

8 Claims, 4 Drawing Sheets

INKJET PRINTING METHOD FOR COLORLESS INK USING COLORLESS INK PRINTHEAD MASKS DEPENDENT ON COLORED INK PRINTING

FIELD OF THE INVENTION

The present invention relates to ink jet printing. It finds particular application in conjunction with providing an image on a receiving medium with a colorless ink on top of any colored inks and will be described with particular reference thereto. It will be appreciated, however, that the invention is also amenable to other applications.

BACKGROUND OF THE INVENTION

Ink jet recording is a printing method in which ink droplets are ejected and made to adhere to a recording medium (e.g., paper). Ink jet recording technology has advanced such that ink jet recording is now used for high-precision printing such as photographic quality printing, which previously was exclusively performed using silver halide photography or offset printing. High-precision ink jet recording has led to the development of ink jet recording media having high gloss relative to standard photographic paper. The recording media used in high-gloss ink jet recording typically include a porous ink receiving layer comprising a pigment (e.g., silica) and a binder coated over a substrate (e.g., paper or film).

Ink used for printing on the above-described high-gloss recording media are typically water-based and include colorants, resin components, and various other additives. Either dyes or pigments may be used as colorants. However, pigments are preferred due to the superior resulting print quality and improved permanence.

Due to color variations in a typical print the recording medium onto which the ink is applied includes areas with relatively more ink than other areas—in fact, some areas of the recording medium may have no ink applied at all. When using pigment-based inks, a glossiness of a resulting print may vary as a function of the amount of ink applied to the recording medium. Consequently, the areas of the recording media having relatively more ink appear different in gloss than the areas of the recording media having relatively less (or no) ink. This difference in gloss, called differential gloss, can be objectionable to the viewer of the printed output.

A further problem when printing with pigment-based inks is referred to as chromatic gloss. Chromatic gloss is the colored appearance of reflected white light. This may be viewed as objectionable to the user.

One method of overcoming these drawbacks is to apply a colorless ink over the colored inks on the recording medium on top of (i.e. after) all of the colored pigmented inks have been applied. Conventionally, applying a colorless ink in this manner has been accomplished by a multi-step process in which the recording medium is passed through a printing apparatus multiple times. For example, the recording medium is passed through the printer a first time during which all of the colored inks are applied to the recording medium. Then, the recording medium is passed through the printer a second time during which the colorless ink is applied to the recording medium. Such a multi-step process may be undesirably time consuming.

To circumvent this reduction in productivity, printers may be designed to apply both the colorless and colored inks concurrently, thereby increasing the overall output. However, it has been observed that the colorless ink can adversely impact the shape of the dots of the printed colored ink on those occasions when the colored ink is applied on top of the colorless ink. The result of this change in dot morphology can give rise to an increase in perceived graininess and/or haze of the printed output. For example, it is preferable that the dots of the printed colored ink be substantially circular in shape. The charge in dot morphology using these prior methods results in a dot that is substantially deformed. Furthermore, the colorless ink is less effective at reducing differential gloss and chromatic gloss when it is not primarily applied on top of the colored inks.

The present invention provides a new and improved method which addresses the above-referenced problems.

SUMMARY OF THE INVENTION

In one embodiment, a printing method includes: applying at least one of a plurality of pigmented colored inks to a receiving surface; and applying a colorless ink to the receiving surface. A majority of the colorless ink is ejected from first nozzles on a printhead used for ejecting the colorless ink. At least 30% of an area on the receiving surface, which is passed over by the first nozzles, is covered with the colorless ink during a single pass of the printhead over the area.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to exemplify the embodiments of this invention.

DETAILED DESCRIPTION OF THE INVENTION

Figure 1:
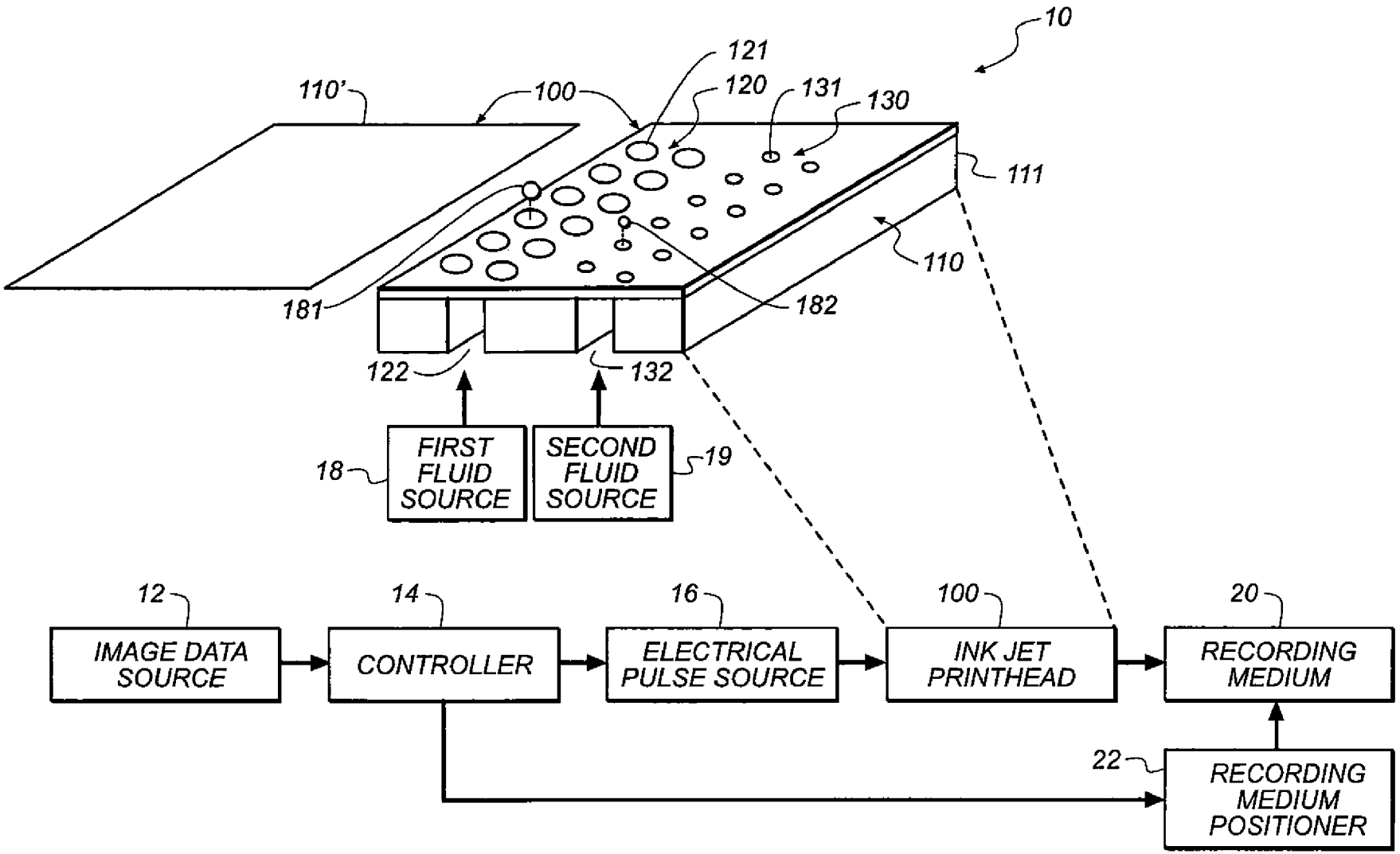
FIG. 1 illustrates a functional block diagram of a printing system in accordance with one embodiment illustrating principles of the present invention.

Referring to FIG. 1, a schematic representation of an inkjet printer system 10 is shown, as described in US 2006/0103691 A1. The system includes a source 12 of image data which provides signals that are interpreted by a controller 14 (including an image processor which is integrated with or separate from controller 14) as being commands to eject drops. As an example, it is contemplated that the source 12 may be from a compact flash card, wired or wireless connection with a digital camera, an image downloaded from the internet or a personal computer; in addition, it is contemplated that the source 12 may be from a media or film scanner. Controller 14 outputs signals to a pulse source 16 of electrical energy pulses that are inputted to an inkjet printhead 100 which includes at least one printhead die 110. In the example shown in FIG. 1, there are two nozzle arrays 120, 130. Nozzles 121 in the first nozzle array 120 have a larger opening area than nozzles 131 in the second nozzle array 130. In fluid communication with each nozzle array is a corresponding ink/fluid delivery pathway 122, 132. With regard to the present invention ink and fluid can be used interchangeably. Ink delivery pathway 122 is in fluid communication with nozzle array 120, and ink delivery pathway 132 is in fluid communication with nozzle array 130. Portions of ink delivery pathways 122 and 132 are shown in FIG. 1 as openings through printhead die substrate 111. One or more printhead die 110 will be included in inkjet printhead 100, but only one printhead die 110 is shown in detail in FIG. 1 while a second print die 110' is schematically shown. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1 are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium or receiving surface 20.

Figure 2:
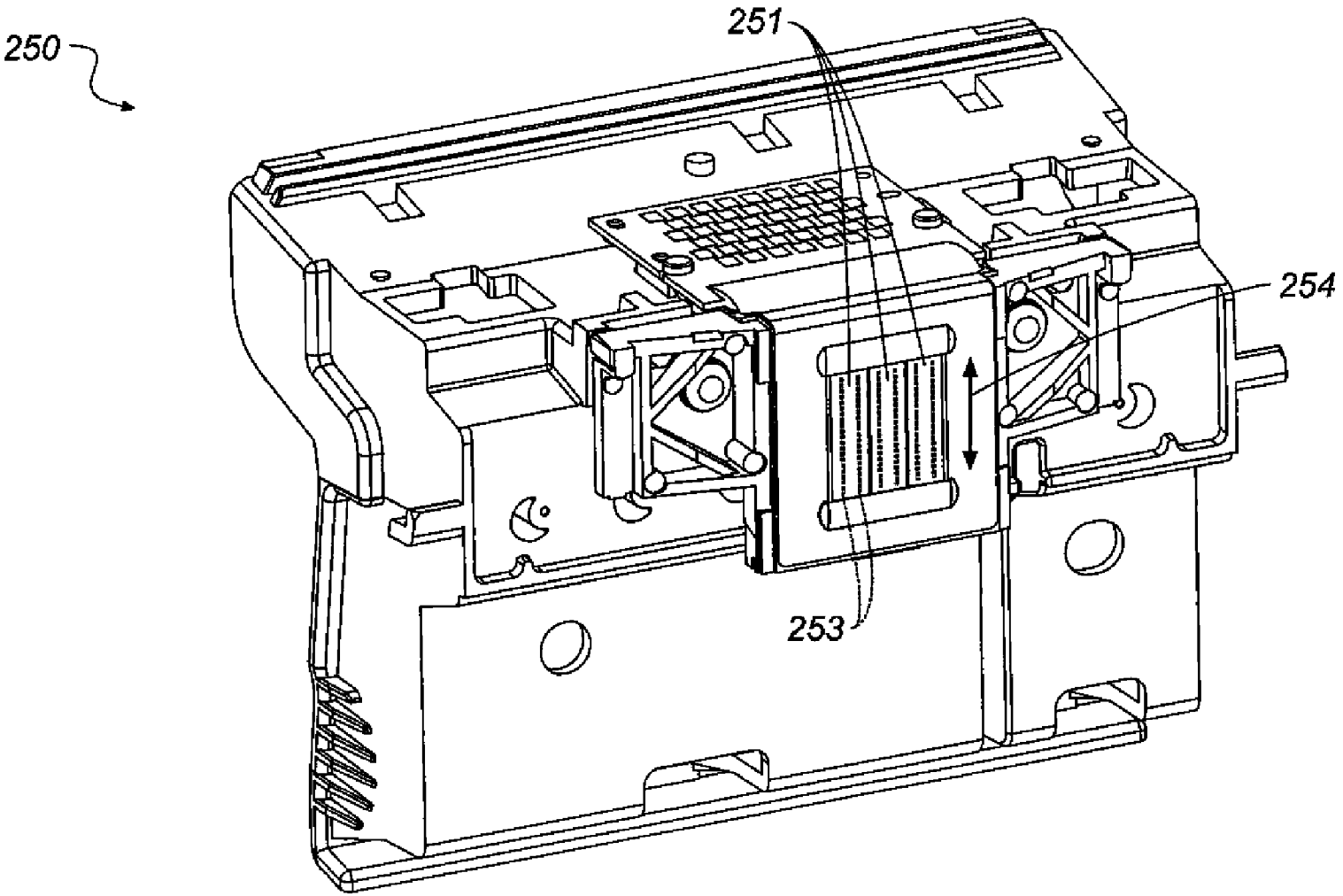
FIG. 2 illustrates a schematic representation of a printhead in accordance with one embodiment illustrating principles of the present invention.

FIG. 2 shows a perspective view of a fluid/ink ejecting portion of a printhead chassis 250, which is an example of an inkjet printhead 100 (see FIG. 1). Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless printing fluid. In one embodiment, the colored inks are pigmented. Each of the six nozzle arrays 253 is disposed along direction 254, and the length of each nozzle array along direction 254 is $1_n$, which is typically on the order of 1 inch or less. In one embodiment, each of the six nozzle arrays 253 includes 640 nozzles at an effective printing resolution of 1200 per inch, so that the length of each nozzle array is approximately 0.533 inch. Typical lengths L of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium 20 (see FIG. 1). Following the printing of a swath, the recording medium is advanced by recording medium positioner 22, as required by controller 14.

With reference to FIG. 1, the controller 14 processes the data from the image source 12. More specifically, the controller 14 analyzes the data associated with the image source 12 to be printed on the receiving medium or receiving surface 20 and determines which of the inks is to be ejected from which of the nozzles 121, 131 during respective passes of the printhead 100 over the receiving medium 20. In one embodiment, it is contemplated that both the colored and colorless inks are capable of being ejected from the array of nozzles 120, 130 onto the receiving medium 20. More specifically, once the receiving medium 20 is inserted into the receiving medium positioner 22, the printhead 100 makes multiple printing passes over the receiving medium 20, and the positioner 22 advances the receiving medium 20 between each of the printhead 100 passes.

Each advancement of the receiving medium 20 by the positioner 22 advances the receiving medium 20 corresponding to a predetermined number of ink jet nozzle spacings on the printhead 100. In one embodiment, the receiving medium 20 is advanced corresponding to the number of nozzles 120, 130 in the first group (e.g., 90). For example, if the printhead 100 includes 630 nozzles for each array and the positioner 22 advances the receiving medium 20 by 90 ink jet nozzle spacings between each pass, the entire printhead 100 does not pass over a given point along the medium advance direction of the receiving medium 20 until the seventh pass.

If the controller 14 determines that a particular pixel address on the receiving medium 20 requires two (2) droplets of cyan colored ink and one (1) droplet of yellow colored ink, the cyan and yellow colored inks are ejected from designated nozzles 121, 131 from nozzle arrays 120, 130 on the printhead 100 onto the receiving medium 20 during the plurality of printhead passes over the receiving medium 20. It is recognized that to eject further inks, such as black, magenta, colorless fluid, etc., a second die 110' (schematically shown in FIG. 1) similar to die 110, or more specifically an arrangement such as shown in FIG. 2 would be used. It is contemplated that for the respective pixel addressees on receiving medium 20, the controller 14 causes the colorless ink to be ejected from one of the printhead nozzles of the second die 110' after a majority or all of the colored inks have been applied. If none of the color inks are to be applied to a particular pixel address, the colorless ink may be applied during any of the printhead passes over the pixel address.

Figure 3:
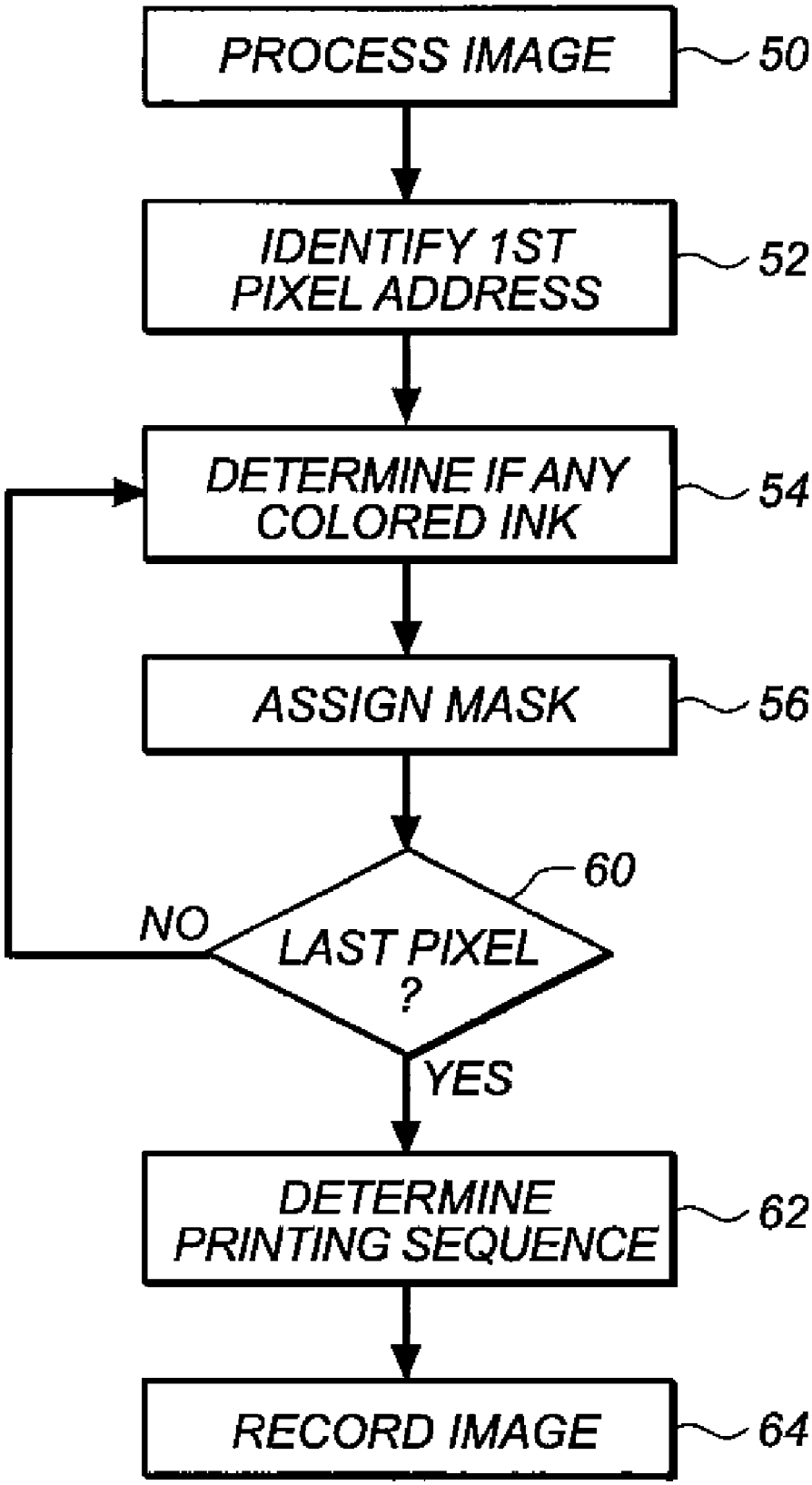
FIG. 3 is an exemplary methodology of printing on a receiving medium in accordance with one embodiment illustrating principles of the present invention.

With reference to FIG. 3, an image to be printed is analyzed and processed by the image processor in a step 50. During a processing step, the processor determines which colored inks, if any, should be applied to each of the pixel addresses on the receiving medium 20 (see FIG. 1). For each of the respective pixel addresses, it is determined that the colored inks will be applied before the colorless ink. As discussed above, if no colored ink is to be applied, the colorless ink may be applied to the pixel at any time. The first pixel on the receiving medium is identified in a step 52. A determination is made in a step 54 whether any colored ink is to be applied to the pixel address. A printhead mask is selected for the pixel in a step 56 as a function of the determination made in the step 54.

Image processing is performed across the image or an image segment. The output of this image processing is a description of how many drops of each colorant is requested at each pixel. This output is then processed through a print masking module of the image processor which decides which nozzle will print a drop and on which pass. In one embodiment, the print mask can be envisioned as a binary matrix of height equal to the number of nozzles used per ink and a predetermined width. If the width of the mask is narrower than the image to be printed, the mask is effectively tiled across the image. This can be represented more formally by the expression:

IF:

$$(\text{image}(i,j)>0)\&(\text{mask}(\text{nozzle}(i),j\%k)) \quad (1)$$

THEN:

$$\text{print a drop at (i,j) with nozzle(i)} \quad (2)$$

Where:

image(i,j)=multitoned image data at image position [ij]

i=image raster row under question j=image raster column under question k=width of print mask %=the modulo operator nozzle(i)=the nozzle poised over raster row i for this pass of the printhead &=the AND operator The term mask(nozzle(i),j % k) selects the correct widthwise and lengthwise position of the print mask-nozzle(i) defines the correct row in the print mask and j % k picks the correct column of the print mask. The above embodiment works well with halftoned output; i.e., output that has either zero or one drop of every colorant at each pixel. As described in U.S. Publication No. 2007/0201054 filed Aug. 30, 2007, MULTILEVEL PRINT MASKING METHOD, this method is easily and readily applied to cases where multiple drops per pixel may be desired at any given pixel address.

Figure 4:
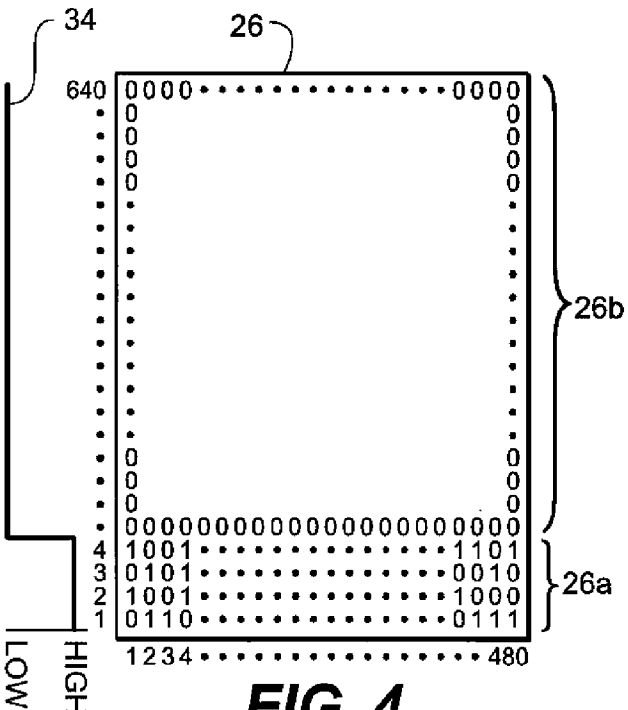
FIG. 4 illustrates a schematic representation of a first printhead mask in accordance with one embodiment illustrating principles of the present invention.

With reference to FIG. 4, a first printhead mask 26 for the colorless ink is illustrated. The first printhead mask 26 is illustrated as a 640×480 mask. The 0's and 1's in each of the 640 positions indicates whether the colorless ink may be ejected from the corresponding ink jet nozzle on the printhead 100, as the printhead is scanned across the receiving medium. More specifically, a 0 indicates that no colorless ink may be ejected from the corresponding ink jet nozzle at that widthwise location, while a 1 indicates that colorless ink may be ejected from the corresponding ink jet nozzle. For example, in the illustrated first printhead mask 26, the colorless ink may only be ejected from selected ink jet nozzles (associated with section 26*a*) in rows 1-4 (e.g., first nozzles) since rows 1-4 contain some 1's—the colorless ink is not ejected from any nozzle (associated with section 26*b*) in rows 5-640 (e.g., second nozzles) if the printhead mask 26 is used since rows 5-640 contain only 0's.

Figure 5:
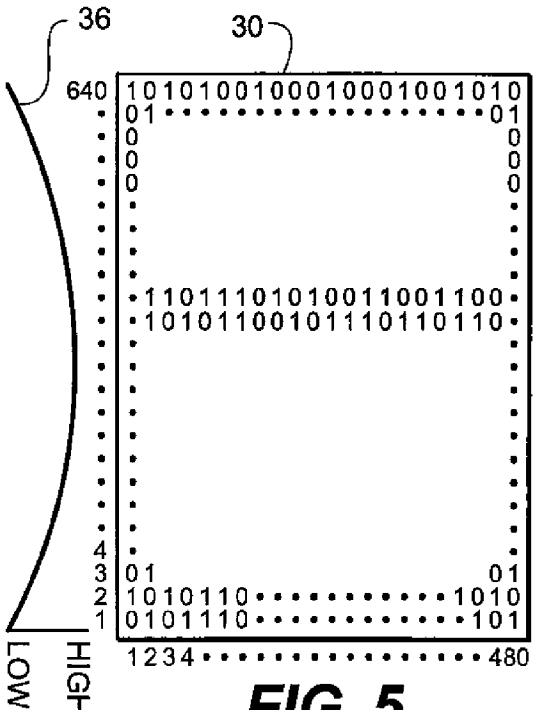
FIG. 5 illustrates a schematic representation of a second printhead mask in accordance with one embodiment illustrating principles of the present invention.

With reference to FIG. 5, a second printhead mask 310 for the colorless ink is illustrated. The second printhead mask 30 is also illustrated as a 640×480 mask. As discussed above, a 0 indicates that no colorless ink may be ejected from the corresponding ink jet nozzle at that pixel address, while a 1 indicates that colorless ink may be ejected from the corresponding ink jet nozzle at in that pixel address. For example, in the illustrated second printhead mask 30, because a 1 is contained in each row, colorless ink may be ejected from any of the ink jet nozzles.

With reference again to FIG. 3, the first printhead mask 26 (see FIG. 4) is selected in the step 56 if any colored ink is to be applied to the pixel. However, if no colored ink is to be applied to the pixel then the second printhead mask 30 (see FIG. 5) is selected in the step 56. In this way, one is assured to apply the colorless ink on top of (i.e., after) any colored ink. Conversely, if no colored ink is applied at a given pixel address, colorless ink may be applied at that pixel address at any time by any of the nozzles ejecting colorless ink.

Figure 6:
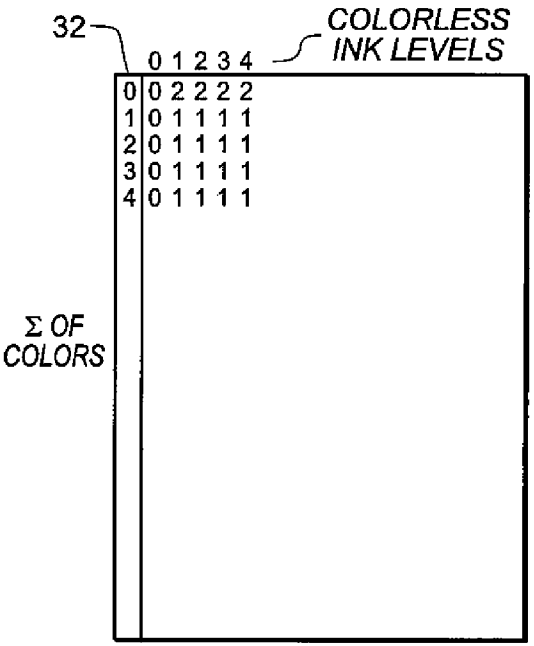
FIG. 6 illustrates a printhead mask look-up table in accordance with one embodiment illustrating principles of the present invention.

With reference to FIG. 6, in one embodiment a look-up table 32 is accessed for identifying which of the printhead masks to assign to the current pixel address. In the illustrated embodiment, a sum of drops of colored inks to be applied to the pixel address is determined. For example, each drop of the cyan, magenta, yellow, and black inks is assigned a value of 1. If two (2) drops of the magenta ink and one (1) drop of the yellow ink is to be applied to the pixel address, the sum of drops is determined as three (3) (i.e., 2 magenta drops+1 yellow drop). The sum of drops of colored inks for the pixel is a first input level here shown in FIG. 6 in the left column of the look-up table 32. The number of drops of colorless ink desired for the pixel is a second input level here shown in FIG. 6 as the top row of the look-up table 32. A printhead mask identifier (e.g., 0, 1, or 2) is indicated in the body of the look-up table 32. The above is an example, and it is recognized that the invention is not limited to a one to one relationship with respect to the drops, the input levels and the values.

For example, a printhead mask identifier of "0" indicates no colorless ink is to be applied to the pixel and, therefore, no printhead mask for the colorless ink is needed; a printhead mask identifier of "1" indicates the first printhead mask 26 (see FIG. 4) is to be applied for the colorless ink; and a printhead mask identifier of "2" indicates the second printhead mask 30 (see FIG. 5) is to be applied for the colorless ink. As a further example, if the sum of colored drops is equal to "0" (i.e., no colored drops are to be applied at the pixel,) and if at least one drop of colorless ink is desired, then print mask identifier 2 will be selected.

A determination is made in a step 60 whether the current pixel address is the last pixel address on the receiving medium. If the current pixel address is not the last pixel address, the next pixel address is identified on the receiving medium after which control returns to the step 54 to determine whether any colored ink is to be applied to the pixel address. If the current pixel address is the last pixel address, a printing sequence is determined for each of the pixels on the receiving medium in a step 62.

The embodiment described above is effective for ensuring that the colorless ink is deposited predominantly over the colored ink. This has the specific advantages of minimizing the deleterious effect the colorless ink may have on the dot morphology of the colored inks if the colored inks are applied predominantly over the colorless ink. Additionally, the method has been shown to be effective in reducing the chromatic gloss artifact; by ensuring the colorless ink is predominantly on top of the colored inks, and, therefore, through proper design of the colorless ink, the reflected light can be made to be essentially neutral in color.

Furthermore, it has been found that by depositing the colorless ink quickly during at least one pass of the print head, overall gloss can be improved and the haziness of the print minimized. Through investigation, it has been determined that by depositing the colorless ink during at least one pass such that at least 30% of the area on the receiving surface under the print head being addressed by section 26*a* of the print mask is covered by colorless ink, the glossiness of the print is significantly improved. In a likewise fashion, it has been found that delivering a flow rate per unit height in a range of 0.01 ml/cm/sec to 0.5 ml/cm/sec and preferably at least 0.014 ml/cm/sec will produce results where differential gloss, chromatic gloss and haze are reduced to an acceptable level in order to create a print that is not objectionable. In this context, unit height refers to the portion of the printhead using mask section 26.

The goals described above of depositing the colorless ink predominantly on top of the colored ink (to reduce grain and chromatic gloss), and apply the colorless ink in a rapid fashion (to increase gloss, reduce haze, and increase productivity)

can all be achieved by proper design of the printing sequence in accordance with the present invention. By designing the print mask shown in FIG. 4 such that a majority of the colorless ink is ejected from ≦50% of a set of nozzles on a printhead used for ejecting the colorless ink during the pass and so that ≧30% of an area on the receiving surface is covered with the colorless ink during a single pass of the printhead over the area, where the area is defined as the portion of the receiving surface passed over by the ≦50% of the set of nozzles all of the above objectives can be obtained. The printing sequence also ensures that a flow rate per unit height of, for example ≧0.014 ml/cm/sec of the colorless ink is provided by the portion of the printhead ejecting the majority of the colorless ink.

The printing sequence described above has been found to produce high-quality glossy images with acceptably low levels of graininess and artifacts. A result of the embodiment described above is that some of the nozzles for the colorless ink will be exercised at a much higher rate than others. Specifically, the ≦50% of the nozzles ejecting a majority of the colorless ink will be used more frequently than the other nozzles ejecting colorless ink. To provide for a more even distribution of the firing duty of the colorless ink across all nozzles a decision process as shown in FIG. 3 is used.

A graph 34 (FIG. 4) of the duty cycle of the nozzles ejecting colorless ink, which results from the printhead mask 26, illustrates substantially higher usage of nozzles for ejecting the colorless ink in the area 26*a* than the other nozzles in area 26*b*. A graph 36 (FIG. 5) of the duty cycle of the nozzles ejecting colorless ink, which results from the printhead mask 30, illustrates a different usage of the nozzles in the middle section of the printhead 100 (see FIG. 1) for ejecting the colorless ink when compared to the graph of the duty cycle 34. The combination of the use of the printhead masks 26, 30 illustrates how the nozzle duty cycle can be controlled to enhance a resulting print.

It is to be understood that although only two (2) printhead masks are discussed with regard to the illustrated embodiment, any number of different printhead masks, which have different duty cycles for the nozzles printing the colorless ink, are contemplated.

With reference again to FIG. 3, once the printhead mask is chosen for each of the pixel addresses, the image is recorded on the receiving medium in a step 64.

The invention has been described in detail with particular reference to certain preferred embodiments thereof, but it will be understood that variations and modifications can be effected within the spirit and scope of the invention.

The invention claimed is:

1. A printing method for printing a plurality of pigmented colored inks and a colorless ink onto a receiving surface with an inkjet printhead having a plurality of nozzles using a plurality of printhead passes, the method comprising:

processing an input color digital image to provide a halftoned image specifying a pattern of colored ink drops and a pattern of colorless ink drops to be printed as a function of pixel address on the receiving surface;

providing a plurality of different colorless ink printhead masks, each colorless ink printhead mask including an array of printhead mask values that are used to control which nozzles and which printhead passes will be used to print the provided pattern of colorless ink drops, the colorless ink printhead masks being predefined independently of the input color image and including;

a first colorless ink printhead mask having the characteristic that the colorless ink drops are controlled to print only during one or more of the last printhead passes so that the colorless ink drops are printed after the majority of the colored ink drops are printed; and a second colorless ink printhead mask having the characteristic that the colorless ink drops are printed during all of the printhead passes;

for each pixel address on the receiving surface, selecting a colorless ink printhead mask, wherein if any colored ink drops are to be printed at the pixel address on the receiving surface, the first colorless ink printhead mask is selected, otherwise if no colored ink drops are to be printed at the pixel address, the second colorless ink printhead mask is selected; and for each pixel address, printing the specified pattern of colored ink drops using appropriate colored ink printhead masks, and printing the specified pattern of colorless ink drops using the selected colorless ink printhead mask;

wherein ≧30% of the pixel addresses where colored ink is printed receive colorless ink during a single pass of the printhead.

2. A printing method as set forth in claim 1, wherein during said applying step, the colorless ink is ejected from ≦50% of first nozzles.

3. The printing method as set forth in claim 2, wherein the ≦50% of first nozzles for ejecting the colorless ink are chosen such that the colorless ink is ejected onto the receiving surface primarily on top of the colored ink.

4. The printing method as set forth in claim 1, further including:

if a pixel address on the receiving surface is identified to receive any of the colored inks, using one of the plurality of the first ink jet nozzles for applying the colorless ink to the pixel address on the receiving surface.

5. The printing method as set forth in claim 4, further including:

if a pixel address on the receiving surface is not identified to receive any of the colored inks, using one of second ink jet nozzles for applying the colorless ink to the pixel address on the receiving surface.

6. The printing method as set forth in claim 5, wherein:

if a pixel address on the receiving surface is not identified to receive any of the colored inks, using any of the first and second ink jet nozzles for applying the colorless ink onto the receiving surface.

7. The printing method as set forth in claim 1, further including:

for each of the pixel addresses, determining a total number of the colored ink drops to be printed at the pixel address; and accessing a look-up table to identify the colorless ink printhead mask to be used at the pixel address as a function of the total number of colored ink drops.

8. The printing method as set forth in claim 7, further including:

for each of the pixel addresses, determining a total number of colorless ink drops to be printed at the pixel address; and accessing the look-up table to identify the colorless ink printhead mask as a function of both the number of colored ink drops and the number of colorless ink drops.

* * * * *